US011114220B2

(12) United States Patent
Jaenicke

(10) Patent No.: US 11,114,220 B2
(45) Date of Patent: Sep. 7, 2021

(54) HOLLOW INSULATOR AND METHOD FOR PRODUCTION THEREOF

(71) Applicant: SIEMENS AKTIENGESELLSCHAFT, Munich (DE)

(72) Inventor: Lutz-Ruediger Jaenicke, Mahlow (DE)

(73) Assignee: Siemens Aktiengesellschaft, Munich (DE)

( * ) Notice: Subject to any disclaimer, the term of this patent is extended or adjusted under 35 U.S.C. 154(b) by 395 days.

(21) Appl. No.: 16/092,229

(22) PCT Filed: Mar. 7, 2017

(86) PCT No.: PCT/EP2017/055245
§ 371 (c)(1),
(2) Date: Oct. 9, 2018

(87) PCT Pub. No.: WO2017/174274
PCT Pub. Date: Oct. 12, 2017

(65) Prior Publication Data

US 2020/0343024 A1 Oct. 29, 2020

(30) Foreign Application Priority Data

Apr. 6, 2016 (DE) ..... 10 2016 205 673.5

(51) Int. Cl.

| | |
|---|---|
| ***H01B 17/32*** | (2006.01) |
| ***H01B 17/14*** | (2006.01) |
| ***H01B 17/42*** | (2006.01) |
| ***H01B 17/58*** | (2006.01) |
| ***H01B 19/00*** | (2006.01) |

(52) U.S. Cl.
CPC ..... *H01B 17/32* (2013.01); *H01B 17/14* (2013.01); *H01B 17/42* (2013.01); *H01B 17/58* (2013.01); *H01B 19/00* (2013.01)

(58) Field of Classification Search
CPC ..... H01B 17/32; H01B 17/14; H01B 17/42; H01B 17/58; H01B 19/00; H01B 17/36; H01B 17/60
USPC .... 174/137 R, 152 R, 142, 12 BH, 143, 135, 174/11 BH, 650, 138 R; 16/2.1, 2.2; 29/592.1, 592
See application file for complete search history.

(56) References Cited

U.S. PATENT DOCUMENTS 3,769,446 A * 10/1973 Martincic ..... H01B 17/28 174/143
3,967,051 A * 6/1976 Moore ..... H01B 17/28 174/143
4,609,775 A * 9/1986 Moran ..... H01B 17/34 174/152 R (Continued)

FOREIGN PATENT DOCUMENTS

CN 1011103424 A 1/2008
CN 201032606 Y 3/2008

(Continued)

*Primary Examiner* — Angel R Estrada
(74) *Attorney, Agent, or Firm* — Laurence A. Greenberg; Werner H. Stemer; Ralph E. Locher

(57) ABSTRACT

A hollow insulator for high electric voltages has an insulating tube and a covering of the insulating tube made from a fiber-reinforced plastic. The covering is placed on an outer surface of the insulating tube. There is also described a method for producing the type of hollow insulator.

7 Claims, 1 Drawing Sheet

(56) References Cited

U.S. PATENT DOCUMENTS

| | | | | |
|---|---|---|---|---|
| 5,466,891 | A * | 11/1995 | Freeman | H01B 17/28 174/142 |
| 6,534,721 | B2 * | 3/2003 | Hoefner | H01B 17/14 174/140 C |
| 7,964,799 | B2 * | 6/2011 | Isberg | H01F 27/04 174/152 R |
| 8,637,773 | B2 * | 1/2014 | Jonsson | B29C 70/58 174/137 B |
| 2001/0040046 | A1 | 11/2001 | Hoefner | |
| 2007/0209790 | A1 | 9/2007 | Kiefer et al. | |
| 2015/0367596 | A1 | 12/2015 | Yoon et al. | |

FOREIGN PATENT DOCUMENTS

| | | | |
|---|---|---|---|
| CN | 101221842 | A | 7/2008 |
| CN | 201387771 | Y | 1/2010 |
| CN | 102280231 | A | 12/2011 |
| CN | 202339774 | U | 7/2012 |
| CN | 203850073 | U | 9/2014 |
| CN | 104715867 | A | 6/2015 |
| CN | 105023659 | A | 11/2015 |
| CN | 204760063 | U | 11/2015 |
| CN | 105172245 | A | 12/2015 |
| CN | 105172245 | B | 8/2017 |
| DE | 10235438 | A1 | 11/2003 |
| EP | 1091365 | B1 | 10/2005 |
| GB | 1022291 | A | 3/1966 |
| JP | H05282944 | A | 10/1993 |

* cited by examiner

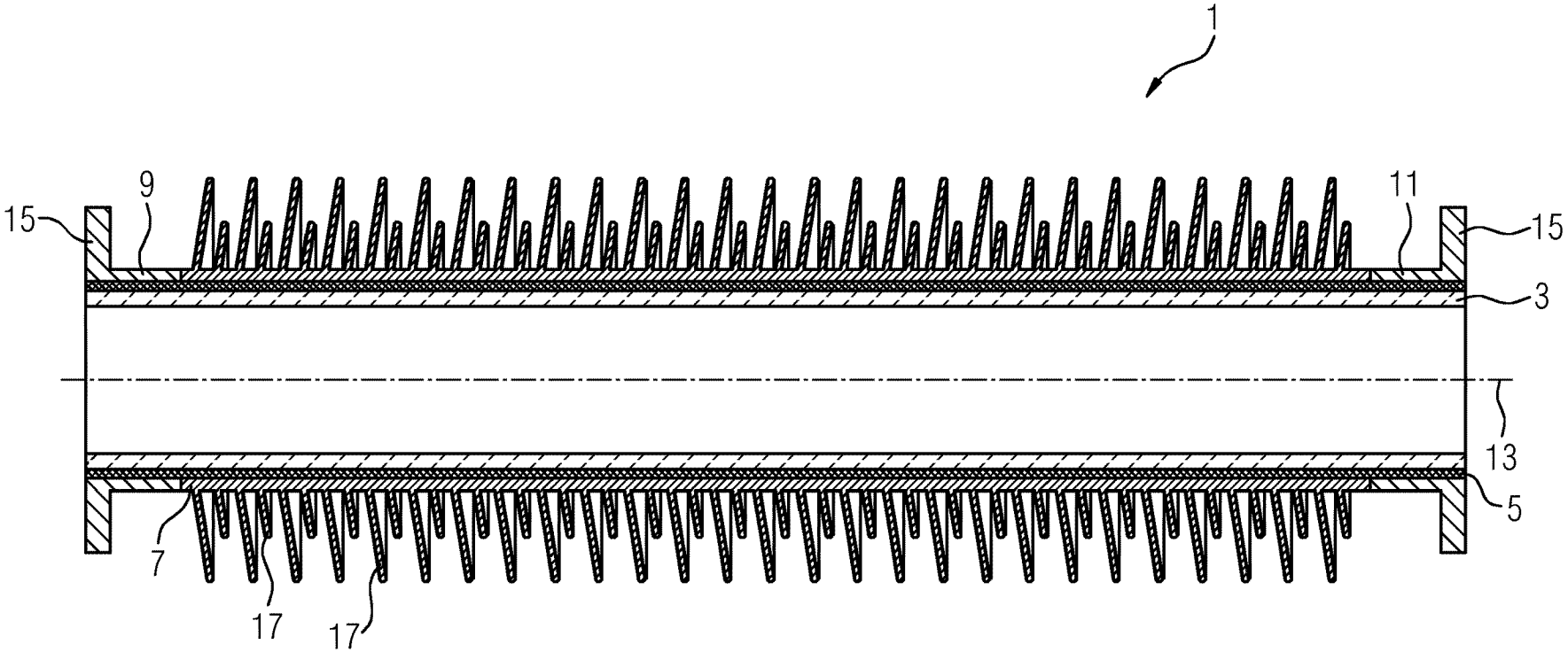
1
15
11
9
15
3
13
5
7
17
17

HOLLOW INSULATOR AND METHOD FOR PRODUCTION THEREOF

BACKGROUND OF THE INVENTION

Field of the Invention

The invention relates to a hollow insulator for high electrical voltages and to a method for producing a hollow insulator of this kind.

The invention relates, in particular, to hollow insulators for air-insulated high-voltage devices or high-voltage components such as, for example, outdoor circuit breakers or outdoor bushings. Hollow insulators for high electrical voltages are often manufactured from ceramic materials or composite materials such as fiber-reinforced plastics. Ceramic hollow insulators have a high mechanical strength, in particular in respect of bending. However, a ceramic hollow insulator which is subject to a high gas pressure is at risk of bursting. Hollow insulators composed of composite materials are mechanically less stable but instead more resistant to bursting than ceramic hollow insulators.

The invention is based on the object of specifying an improved hollow insulator for high electrical voltages and a method for producing a hollow insulator of this kind.

SUMMARY OF THE INVENTION

According to the invention, the object is achieved in respect of the hollow insulator by the features as claimed and in respect of the method by the features as claimed.

Advantageous refinements of the invention are the subject matter of the dependent claims.

A hollow insulator according to the invention for high electrical voltages comprises an insulating tube and a sheathing of the insulating tube, which sheathing is manufactured from a fiber-reinforced plastic and bears against an outer surface of the insulating tube. The insulating tube is manufactured, for example, from a ceramic material or a glass or a plastic.

A hollow insulator according to the invention therefore advantageously combines the mechanical stability of an insulating tube which is manufactured, for example, from a ceramic material or a glass or a plastic with the resistance to bursting of a fiber-reinforced plastic. A hollow insulator according to the invention is therefore mechanically more stable than a hollow insulator which is manufactured from a fiber-reinforced plastic, and more resistant to bursting than a hollow insulator which is manufactured, for example, from a ceramic material or a glass or a plastic.

One refinement of the invention provides an electrically insulating shielding which is arranged around the insulating tube and the sheathing. This refinement of the invention is particularly advantageous when the hollow insulator is used outdoors, in the case of which it is subject to changing weather conditions, in particular precipitation.

A further refinement of the invention provides at least one flange which is arranged at one end of the hollow insulator and has a flange collar which runs in an annular manner around an insulator longitudinal axis of the hollow insulator. Here, for example, at least one flange is connected to the insulating tube or to the sheathing.

Flanges which are arranged at ends of the hollow insulator advantageously allow for reliable and simple connection of the hollow insulator to further components.

In the method according to the invention for producing a hollow insulator for high electrical voltages, an insulating tube is manufactured, for example, from a ceramic material or a glass or a plastic and the insulating tube is sheathed with a fiber-reinforced plastic. The method allows for the production of a hollow insulator having the abovementioned advantages.

One refinement of the method provides that the insulating tube is sheathed with the fiber-reinforced plastic by at least one prefabricated fiber mat being arranged around the insulating tube and then the plastic being introduced into the at least one fiber mat by vacuum impregnation. An alternative refinement of the method provides that the insulating tube is sheathed with a fiber-reinforced plastic by the fiber-reinforced plastic being filament-wound around the insulating tube in a wet or dry state. Both of the abovementioned refinements of the method allow for the sheathing of an insulating tube composed of a ceramic material with a fiber-reinforced plastic, wherein the advantageousness of one of these refinements can depend on the materials respectively used for producing the insulating tube and/or the sheathing.

A further refinement of the method provides that a flange is arranged at at least one end of the insulating tube before the sheathing of the insulating tube. Here, the at least one flange is connected to the insulating tube, for example, by cementing. As an alternative to this, a flange can be arranged at at least one end of the sheathing after the sheathing of the insulating tube. Here, the at least one flange is connected to the sheathing, for example, by adhesive-bonding connection.

The above-described properties, features and advantages of this invention and also the way in which these are achieved will become clearer and more distinctly comprehensible in connection with the following description of exemplary embodiments which will be explained in more detail in connection with a drawing.

BRIEF DESCRIPTION OF THE DRAWING

The sole FIGURE of the drawing is a sectional view of a hollow insulator according to the invention.

DESCRIPTION OF THE INVENTION

In the drawing, the single FIGURE shows a sectional illustration of a hollow insulator 1 for high electrical voltages. The hollow insulator 1 comprises an insulating tube 3, a sheathing 5 of the insulating tube 3, a shielding 7 and two flanges 9, 11. The insulating tube 3 is manufactured from a ceramic material or a glass or a plastic such as, for example, polymethyl methacrylate. The sheathing 5 is manufactured from a fiber-reinforced plastic, for example from a fiber-reinforced cast resin such as epoxy resin, and bears against an outer surface of the insulating tube 3. For example, for the purpose of producing the hollow insulator 1, the insulating tube 3 is sheathed with the fiber-reinforced plastic by at least one prefabricated fiber mat being arranged around the insulating tube 3 and then the plastic being introduced into the at least one fiber mat by vacuum impregnation. As an alternative, the insulating tube 3 is sheathed with the fiber-reinforced plastic by the fiber-reinforced plastic being filament-wound around the insulating tube 3 in a wet or dry state.

The flanges 9, 11 are arranged at opposite ends of the hollow insulator 1 and each have a flange collar 15 which runs in an annular manner around an insulator longitudinal axis 13 of the hollow insulator 1. In the exemplary embodiment illustrated in the FIGURE, each flange 9, 11 is connected to an outer surface of the sheathing 5. To this end, the flanges 9, 11 are adhesively bonded, for example, to the sheathing 5. An alternative exemplary embodiment (not illustrated) provides that the sheathing 5 surrounds only a section of the insulating tube 3 that runs between the flanges 9, 11 and each flange 9, 11 is directly connected to the insulating tube 3. To this end, the flanges 9, 11 are cemented, for example, to the insulating tube 3.

The shielding 7 is manufactured from an electrically insulating material, for example from a silicone. The shielding 7 is arranged between the flanges 9, 11 on an outer surface of the sheathing 5 and has a plurality of shield-like fins 17 which run in an annular manner around the insulator longitudinal axis 13.

Although the invention has been illustrated and described in more detail by preferred exemplary embodiments, the invention is not restricted by the disclosed examples and other variations can be derived therefrom by a person skilled in the art without departing from the scope of protection of the invention.

The invention claimed is:

1. A method for producing a hollow insulator for high electrical voltages, the method comprising:

manufacturing an insulating tube; and sheathing the insulating tube with a fiber-reinforced plastic by arranging at least one prefabricated fiber mat around the insulating tube and then introducing plastic into the at least one fiber mat by a vacuum impregnation process.

2. The method according to claim 1, which comprises manufacturing the insulating tube from a material selected from the group consisting of a ceramic material, a glass and a plastic.

3. The method according to claim 1, wherein a flange is arranged at at least one end of the insulating tube prior to sheathing the insulating tube.

4. The method according to claim 3, which comprises connecting the at least one flange to the insulating tube by cementing.

5. The method according to claim 1, which comprises placing a flange at at least one end of the sheathing after sheathing the insulating tube.

6. The method according to claim 5, which comprises connecting the at least one flange to the sheathing by an adhesive-bonding connection.

7. A method for producing a hollow insulator for high electrical voltages, the method comprising:

manufacturing an insulating tube; and sheathing the insulating tube with a fiber-reinforced plastic by filament-winding the fiber-reinforced plastic around the insulating tube in a wet or dry state.

* * * * *